US008764154B2

(12) United States Patent
Sugimura et al.

(10) Patent No.: US 8,764,154 B2
(45) Date of Patent: Jul. 1, 2014

(54) PRINTING APPARATUS AND PRINTING METHOD

(71) Applicant: Canon Kabushiki Kaisha, Tokyo (JP)

(72) Inventors: Hideo Sugimura, Tokyo (JP); Takashi Nojima, Tokyo (JP); Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/644,484

(22) Filed: Oct. 4, 2012

(65) Prior Publication Data

US 2013/0120487 A1 May 16, 2013

(30) Foreign Application Priority Data

Nov. 11, 2011 (JP) ..... 2011-247810

(51) Int. Cl.
*B41J 29/38* (2006.01)

(52) U.S. Cl.
USPC ..... 347/16

(58) Field of Classification Search
USPC ..... 347/4–5, 8, 14, 16, 19, 104, 106; 400/76, 583, 583.3, 611, 708
See application file for complete search history.

(56) References Cited

U.S. PATENT DOCUMENTS

| | | | | |
|---|---|---|---|---|
| 4,314,757 | A * | 2/1982 | Anderson et al. | 355/29 |
| 6,575,546 | B2 * | 6/2003 | Matsumoto et al. | 347/14 |
| 6,975,381 | B2 * | 12/2005 | Heya | 355/29 |
| 8,404,827 | B2 * | 3/2013 | Chung et al. | 536/24.1 |
| 8,517,496 | B2 * | 8/2013 | Sugimura et al. | 347/16 |
| 2011/0279508 | A1 * | 11/2011 | Naito | 347/16 |
| 2011/0279510 | A1 * | 11/2011 | Takeuchi et al. | 347/16 |

FOREIGN PATENT DOCUMENTS

JP 2001-239715 A 9/2001

* cited by examiner

*Primary Examiner* — Anh T. N. Vo
(74) *Attorney, Agent, or Firm* — Canon USA, Inc., IP Division

(57) ABSTRACT

A printing apparatus includes a conveyance unit, a printing unit, a detection unit, and a control unit. The conveyance unit conveys a sheet that is a continuous sheet. The printing unit prints an image onto the conveyed sheet. The detection unit detects a splice of the conveyed sheet. A following sheet area follows and is continuous from the splice. The control unit adjusts, in response to the detection unit detecting a splice of the conveyed sheet, the conveyance by the conveyance unit of the following sheet area depending on conveyance characteristics of the following sheet area.

8 Claims, 8 Drawing Sheets

PRINTING APPARATUS AND PRINTING METHOD

BACKGROUND OF THE INVENTION

1. Field of the Invention

The present invention relates to a printing apparatus for printing using a continuous roll sheet.

2. Description of the Related Art

In printing of a large number of sheets, such as printing in the photo print service, continuous roll sheets are used. In manufacturing the continuous roll sheets, to improve the manufacturing yield, end portions of a plurality of continuous sheets with lengths less than a required length may be attached to each other with a fixing material (hereinafter, referred to as a tape), such as a splicing tape, to form a roll with a required length. The continuous roll sheet has one or more taped splices (connected portions) at random positions.

An apparatus discussed in Japanese Patent Application Laid-Open No. 2001-239715 detects a tape using an optical sensor to detect a position of a splice, determines an area including the splice as a non-recordable area, and performs control such that printing is not performed onto the non-recordable area.

In printing high-definition photo images and the like, depending on slight differences in the types of the sheet (for example, the type of paper, the quality of paper, and the thickness of paper) to be used, the conveyance characteristics of the sheet change. The changed conveyance characteristics cause differences in the sheet conveyance amount and the sheet conveyance speed, resulting in differences in the print image quality. Due to the differences in the sheet conveyance characteristics before and after the splice portion of the continuous sheet, images having different image quality, such as hues and granularity, are formed. The print image quality change in the middle of the plurality of pages of the printed material such as a photographic album gives a strong feeling of strangeness to the viewer. To solve the problem, it is desirable to maintain the similar quality of the images sequentially printed on the continuous sheet. However, Japanese Patent Application Laid-Open No. 2001-239715 discloses nothing about the problem and a method for solving the problem.

SUMMARY OF THE INVENTION

The present invention is directed to a method for reducing changes in print image quality before and after a splice in printing onto a continuous sheet having the splice.

According to an aspect of the present invention, a printing apparatus includes a conveyance unit configured to convey a sheet that is a continuous sheet, a printing unit configured to print an image onto the conveyed sheet, a detection unit configured to detect a splice of the conveyed sheet, wherein a following sheet area follows and is continuous from the splice, and a control unit configured to adjust, in response to the detection unit detecting a splice of the conveyed sheet, the conveyance by the conveyance unit of the following sheet area depending on conveyance characteristics of the following sheet area.

According to exemplary embodiments, conveyance of a following sheet is adjusted depending on conveyance characteristics of the following sheet, which is continuous from a splice of a continuous sheet. Consequently, even if the sheet characteristics differ before and after the splice, the printing can be continued while maintaining similar print image quality without giving a feeling of strangeness to the viewer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A printing apparatus employing an inkjet method according to exemplary embodiments is described below. The printing apparatus is a high-speed line printer that can perform one-sided printing and two-sided printing using a long continuous sheet, the continuous sheet is longer than the length of a unit of print (a page or a unit image), which is to be repeated in the conveyance direction. The printing apparatus is suitably used, for example, in the field of printing of a large number of sheets, such as printing in print laboratories.

Figure 1:
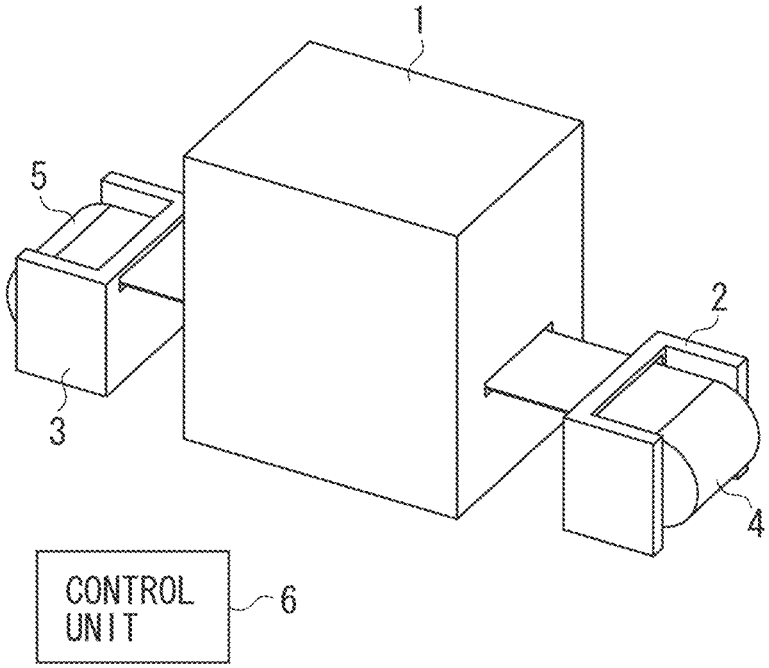
FIG. 1 is a diagram illustrating the overall appearance of a printing apparatus according to a first exemplary embodiment.

FIG. 1 is a diagram illustrating the overall appearance of the printing apparatus according to a first exemplary embodiment. The printing apparatus includes a printer body unit 1, a sheet supplying unit 2, a sheet winding unit 3, and a control unit 6. The sheet supplying unit 2 holds a roll sheet 4 wound in a rolled state, and supplies the continuous sheet to the printer body unit 1 while pulling the sheet from the roll. In the printer body unit 1, a plurality of images is sequentially printed on the continuous sheet. The printed continuous sheet is wound by the sheet winding unit 3 as a roll sheet 5. The control unit 6 includes a controller, a memory, and various input-output (I/O) interfaces. The control unit 6 performs overall control of the printing apparatus. The control unit 6 may be installed in the printing apparatus itself, or may be an external host computer connected to the printing apparatus. At a point on the sheet conveyance path, the side closer to the sheet supplying unit 2 is referred to as "upstream", and the other side is referred to as "downstream".

The sheet held by the sheet supplying unit 2 may be any continuous sheet other than the sheet wound in the rolled state. For example, a continuous sheet on which lines of perforations with a unit length are formed, to be folded back at each line, may be stored in the sheet supplying unit 2.

Figure 3:
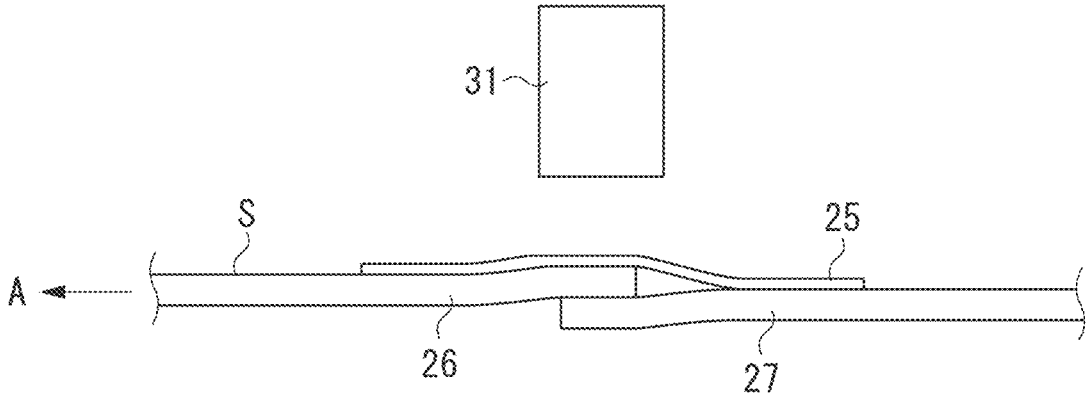
FIG. 3 is a cross-sectional view illustrating a splice of a continuous sheet.

As illustrated in FIG. 3, the continuous sheet to be used in the printing apparatus has one or more splices (connected portions) taped or glued at random positions. The splice is formed on the continuous sheet at the time the roll is manufactured. In addition, when a user uses up a continuous roll sheet, the user may connect the sheet to another sheet to form a new continuous sheet, and may continue the printing. In such a case, a splice is formed in the middle of the continuous sheet.

In FIG. 3, the preceding continuous sheet (the preceding sheet area 26) and the following continuous sheet (the following sheet area 27) are connected with the splice, and form a continuous sheet S. In the example, a part of the preceding sheet area 26 is laid over a part of the following sheet area 27, and glued together, and further, a tape 25 is attached over the glued part. The part on which the tape 25 is attached is the splice, which is thicker than the original sheet due to the overlapped part of the sheets 26 and 27 and the thickness of the tape 25.

Figure 2A:
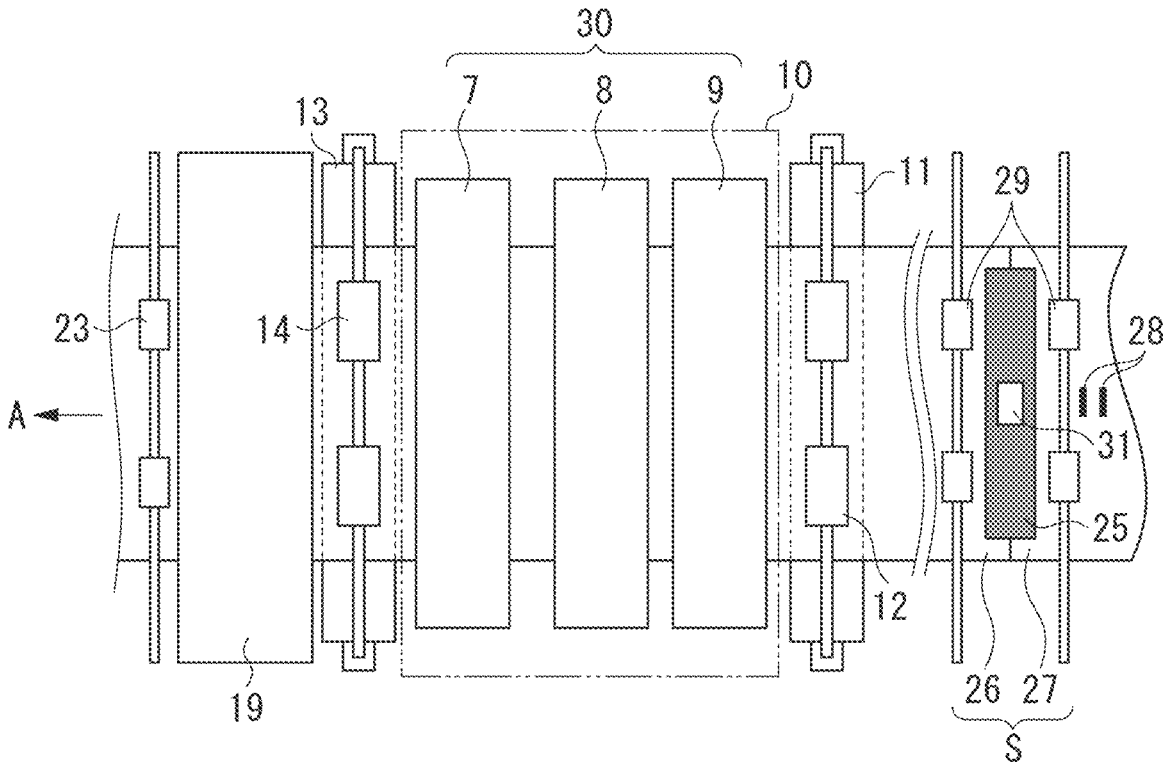
FIGS. 2A, 2B, and 2C illustrate an internal structure of a printing unit.
Figure 2B:
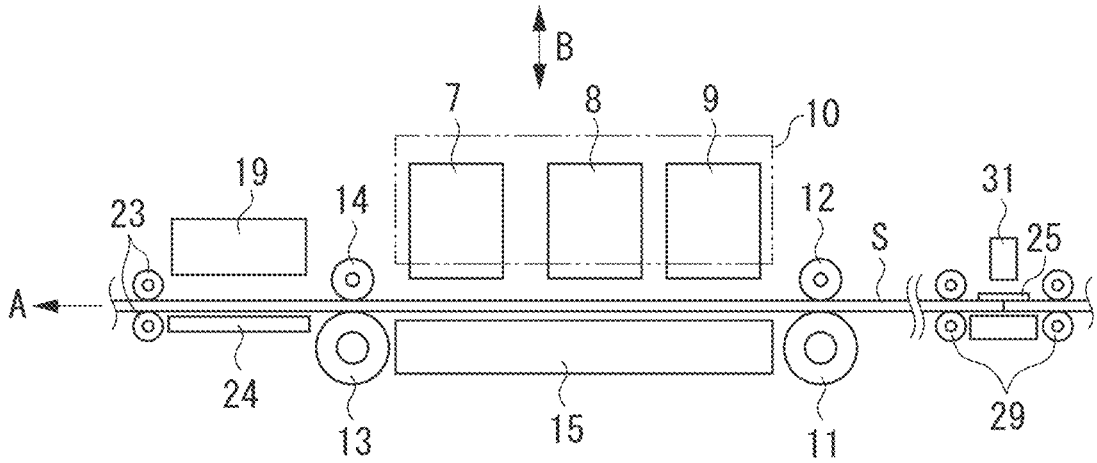
Figure 2C:
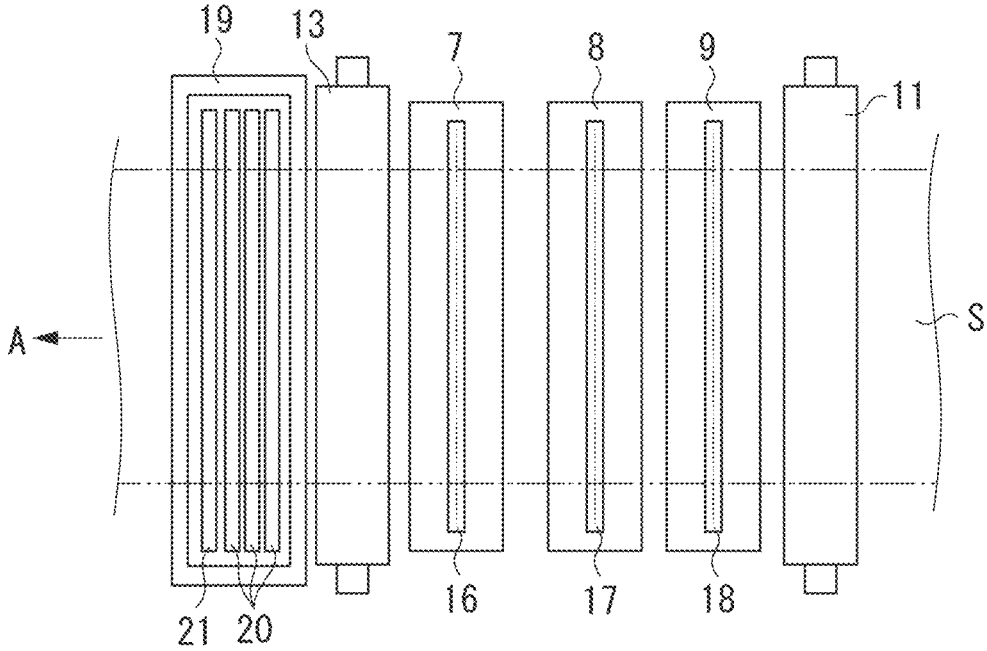

FIGS. 2A, 2B, and 2C illustrate an internal structure of the printer body unit 1. FIG. 2A is a top view, FIG. 2B is a side view, and FIG. 2C is a bottom view of main members disposed over the sheet viewed from the bottom. The continuous sheet S supplied from the sheet supplying unit 2 to the printer body unit 1 is conveyed in the arrow A direction in a printing unit 30.

In the printing unit 30, a sheet conveyance mechanism (a conveyance unit) includes a pair of conveyance rollers at the upstream side and a pair of conveyance rollers at the downstream side. The pair of conveyance rollers at the upstream side includes a conveyance roller 11 and a plurality of pinch rollers 12, which is driven and rotated by the conveyance roller 11. The pair of conveyance rollers at the downstream side includes a conveyance roller 13 and a plurality of pinch rollers 14, which is driven and rotated by the conveyance roller 13. A platen 15 guides and holds the undersurface of the continuous sheet at a recording position.

The printing unit 30 includes a plurality of print heads of an inkjet method. Each of the print heads includes a line-type print head on which inkjet-type nozzle arrays are formed such that the nozzle arrays cover a maximum print width expected to be used. The ink nozzle arrays may be formed over the whole area in the width direction with unit nozzle tips arranged in a regular pattern such as a staggered arrangement, or over the whole area in the width direction in an array. The inkjet method may be a method using a heating element, a method using a piezoelectric element, a method using an electrostatic element, a method using a micro electro mechanical system (MEMS) element, or the like.

The ink of each color is supplied from an individual ink tank via an ink tube to the each print head. In the present exemplary embodiment, the printing unit 30 includes three print heads of a cyan head 7 for cyan ink, a magenta head 8 for magenta ink, and a yellow head 9 for yellow ink. As illustrated in FIG. 2C, a nozzle array 16 is formed on a discharge surface of the cyan head 7, a nozzle array 17 is formed on a discharge surface of the magenta head 8, and a nozzle array 18 is formed on a discharge surface of the yellow head 9, respectively. The number of colors and the number of heads are not limited to three, but more or fewer number of colors and print heads may be used.

To each of the print heads, the ink tube is connected, and ink is supplied from the ink tank (not illustrated). Each print head may be integrated with the ink tank storing the ink of the corresponding color to form a unit. The print heads are integrally held by a head holder 10. The head holder 10 can be moved in the arrow B direction by a drive mechanism.

A scanning apparatus (a reading unit) 19 is disposed further downstream of the pair of conveyance rollers (the pinch rollers 14) at the downstream side. The scanning apparatus 19 is used to read a conveyance adjustment image or a test image printed on the continuous sheet using the printing unit 30. As illustrated in FIG. 2C, the scanning apparatus 19 includes a light emitting unit having light emitting elements 20 of red, green, blue (RGB) three colors, and a light receiving unit having an image sensor 21. The image sensor 21 includes a charge coupled device (CCD) image sensor or a complementary metal-oxide semiconductor (CMOS) image sensor. A white reference plate 24 is disposed at a reading position of the image sensor 21, such that the plate 24 faces the image sensor 21 across the sheet. The white reference plate 24 includes a white plate used for color calibration in the image sensor 21. At a position downstream of the scanning apparatus 19 and the white reference plate 24, a pair of discharge rollers 23 is provided to discharge the continuous sheet.

At a position upstream side of the conveyance roller pair (the plurality of pinch rollers 12), a detection unit 31 for optically detecting the splice (the tape 25) of the continuous sheet, in a noncontact manner, from above the sheet surface is provided. The detection unit 31 includes a light emitting unit for emitting light on the sheet surface from a slanting direction, and an array sensor for detecting the reflected light. The preceding sheet area 26 and the following sheet area 27 are glossy white, and have a high reflectivity. On the other hand, the surface of the tape 25 is black and matted, and has a low reflectivity. Using the difference in the reflectivity, the detection unit 31 detects the passage of the tape 25 over the detection position of the sensor. The detection unit 31 can also detect the height of the sheet surface by detecting which elements of the array sensor having more than one light reception element mainly receive the reflected light. Two pairs of guide rollers 29 are provided upstream and downstream of the detecting unit 31, with each of the pair of guide rollers facing across the sheet. The pair of guide rollers 29 stabilizes the position of the sheet at the detection position of the detection unit 31 in the sheet height direction, and stabilizes the detection accuracy.

Figure 4:
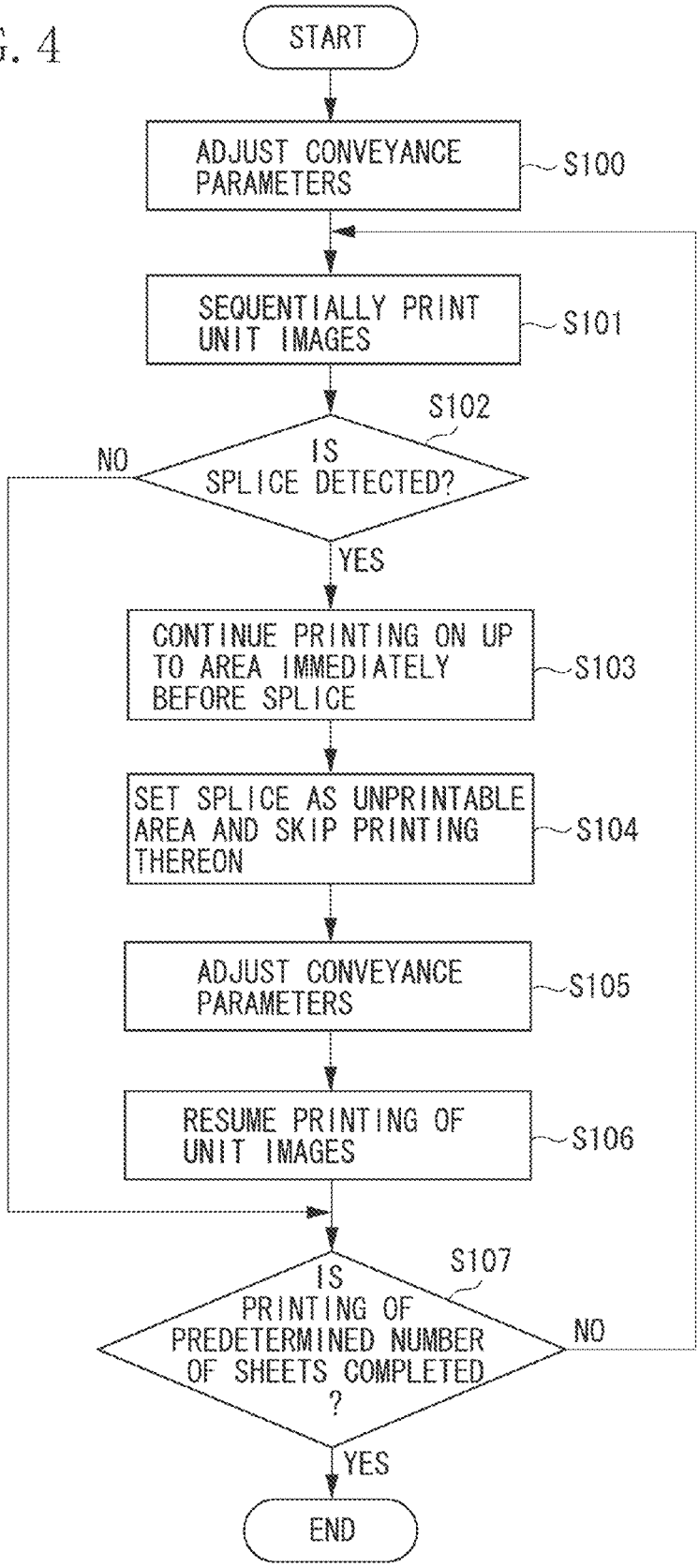
FIG. 4 is a flowchart illustrating the whole sequence of a printing operation.

FIG. 4 is a flowchart illustrating the whole sequence of a printing operation controlled by the control unit 6. In step S100, the control unit 6 adjusts predetermined parameters for sheet conveyance control in conveying the sheet to be printed. The adjustment of the predetermined parameters in the sheet conveyance control is referred to as "conveyance adjustment". The conveyance adjustment is described in detail below.

In step S101, the control unit 6 starts sequential printing of a plurality of unit images onto the continuous sheet. In step S102, during the printing, the detection unit 31 detects a splice of the continuous sheet. If the detection unit 31 detects the splice (YES in step S102), the processing proceeds to step S103. If the detection unit 31 does not detect the splice (NO in step S102), the processing proceeds to step S107.

In step S103, the control unit 6 performs control such that the printing apparatus continues the printing of the unit images until the detected splice reaches the print position of the yellow head 9, which is located at the most upstream position of the printing unit 30, to print as many unit images as possible. The length of the conveyance path from the detection position of the detection unit 31 to the print position of the yellow head 9 located at the most upstream position is defined in the design. The number of unit images printable onto the area of the length can be calculated from the length of the unit image in the conveyance direction.

In step S104, the control unit 6 sets an area containing the splice as an unprintable area. While the unprintable area passes through the print position, the printing is skipped without performing the printing processing thereon. Onto the unprintable area, the ink is not applied and the area is left blank.

In step S105, after the unprintable area passes through the print position, to convey the following sheet area continuous from the splice, the control unit 6 performs the conveyance adjustment similar to the processing in step S100. In the specification, in the continuous sheet, the sheet before the splice is referred to as "the preceding sheet area", and the following sheet continuous from the splice is referred to as "the following sheet area".

In step S106, after performing the conveyance adjustment, the control unit 6 resumes the printing of the unit images. In step S107, the control unit 6 determines whether printing of the predetermined number of sheets is completed (YES) or not (NO). If the control unit 6 determines that the printing is not completed (NO in step S107), the processing returns to step S101, and the control unit 6 repeats the processing. If the control unit 6 determines that the printing is completed (YES in step S107), the control unit 6 ends the sequence.

The conveyance adjustment performed in steps S100 and S105 is described below. As mentioned above, in printing high-definition photo images or the like, depending on slight differences in the types of the sheet (for example, the type of paper, the quality of paper, and the thickness of paper) to be used, the conveyance characteristics of the sheet change. The changed conveyance characteristics cause differences in the sheet conveyance amount and the sheet conveyance speed, resulting in differences in the print image quality. Due to the differences in the sheet conveyance characteristics before and after the splice portion of the continuous sheet, images having different image quality, such as hues and granularity, are formed. The print image quality change in the middle of a plurality of pages of a printed material such as a photographic album gives a strong feeling of strangeness to the viewer. To solve the problem, it is desirable to maintain the similar quality of the images sequentially printed on the continuous sheet.

To solve the problem, in the present exemplary embodiment, in step S100, an actual sheet conveyance amount is detected using the preceding sheet area, and based on the detection, conveyance (a conveyance amount or a conveyance speed) in the sheet conveyance of the preceding sheet area is adjusted. More specifically, before the printing of the image onto the preceding sheet is started, from the top of the sheet, the control unit 6 performs control such that adjustment patterns for conveyance adjustment are printed using the print heads of each color. Then, the scanning apparatus 19 reads the printed adjustment patterns, and detects the amount of deviation of the actual sheet conveyance from an amount of target ideal conveyance. The control unit adjusts control parameters relating to the sheet conveyance (a conveyance amount or a conveyance speed) of the preceding sheet area, such that the deviation of the detected conveyance amount is corrected.

In step S105, the control unit 6 detects an actual sheet conveyance amount using the following sheet area, and acquires information about the conveyance characteristics of the sheet. Based on the acquired conveyance characteristics, the control unit 6 adjusts conveyance (a conveyance amount or a conveyance speed) in the sheet conveyance of the following sheet area. More specifically, after the splice passes through the printing unit 30, from the top of the following sheet area, the control unit 6 performs control such that adjustment patterns for conveyance adjustment are printed using the print heads of each color. Then, the scanning apparatus 19 reads the printed adjustment patterns, and detects the deviation of the amount of the actual sheet conveyance from an amount of target ideal conveyance. The control unit 6 adjusts the control parameters relating to the sheet conveyance (the conveyance amount or the conveyance speed) of the following sheet area, such that the detected deviation of the amount of the conveyance is corrected. If the conveyance characteristics change to the point at which a sheet conveyance state is caused to change before and after the splice on the continuous sheet, for example, if the coefficient of friction on the sheet surface or the thickness of the sheet changes, in steps S100 and S105, different control parameters are set. By the processing, even if the sheet conveyance characteristics differ in the preceding sheet area and the following sheet area, similar conveyance states can be achieved. As a result, the print quality of the series of the images sequentially printed on the continuous sheet can be similarly maintained. The adjustment patterns can be formed in the top part of the following sheet area, that is, in a part close to the splice as much as possible, to reduce the sheet consumption. However, it is not always necessary to form the adjustment patterns in the top area immediately after the splice.

Figure 5:
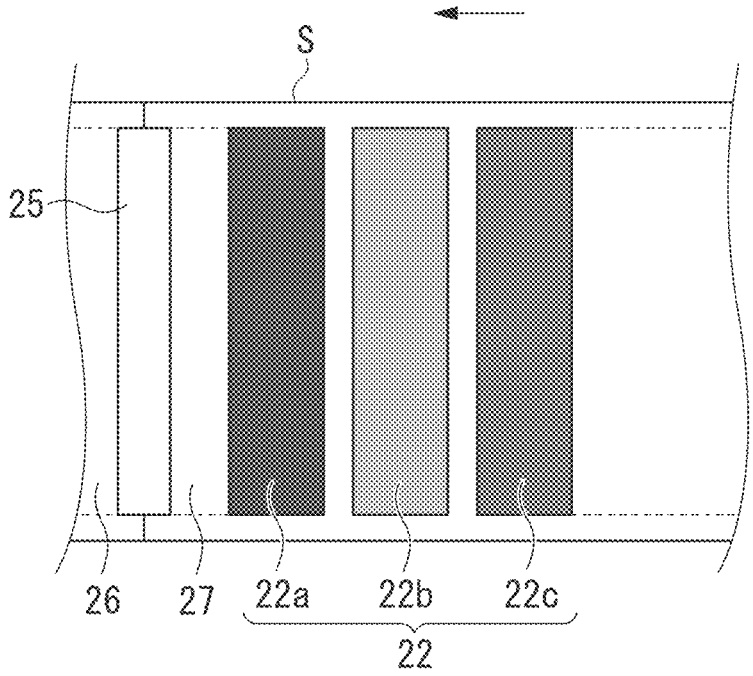
FIG. 5 illustrates adjustment patterns for sheet conveyance adjustment.

FIG. 5 illustrates an example of an adjustment pattern 22 for conveyance adjustment. Using the print heads of the three colors in the printing unit 30, the printing apparatus ejects the ink of the different colors to overprint a plurality of unit patterns of a reference color (for example, a process black color) in a top area of the following sheet area 27. In the example, the adjustment pattern 22 including three unit patterns of 22*a*, 22*b*, and 22*c* is formed. To form the three unit patterns, the amount of conveyance per unit is slightly changed among the patterns. As a result, three unit patterns having a slightly different positional deviation (misregistration) in the ink impact positions of the three colors are formed. The number of unit patterns to be formed is not limited to three, but two or more than three patterns may be formed.

The scanning apparatus 19 reads the adjustment pattern 22 formed as described above, and acquires the data as color image data. The control unit 6 performs color analysis of the color image data, and determines which one of the unit patterns 22*a*, 22*b*, and 22*c* is closest to the predetermined ideal reference color (in this example, the process black). The unit pattern closest to the ideal reference color is the pattern formed by appropriate conveyance and having the most suitable registration of the three colors. The control unit 6 applies the control parameters in the sheet conveyance at the time of the printing of the unit pattern to the sheet conveyance in printing the images onto the following sheet area, and continues the printing of the images onto the following sheet area 27. If the conveyance system for conveying the sheet is driven by a stepping motor, the conveyance adjustment is performed by fine adjustment of the pulse rate. If the conveyance system is driven by a direct current (DC) servomotor, the conveyance adjustment is performed by fine adjustment of the servo calculation amount.

Figure 6A:
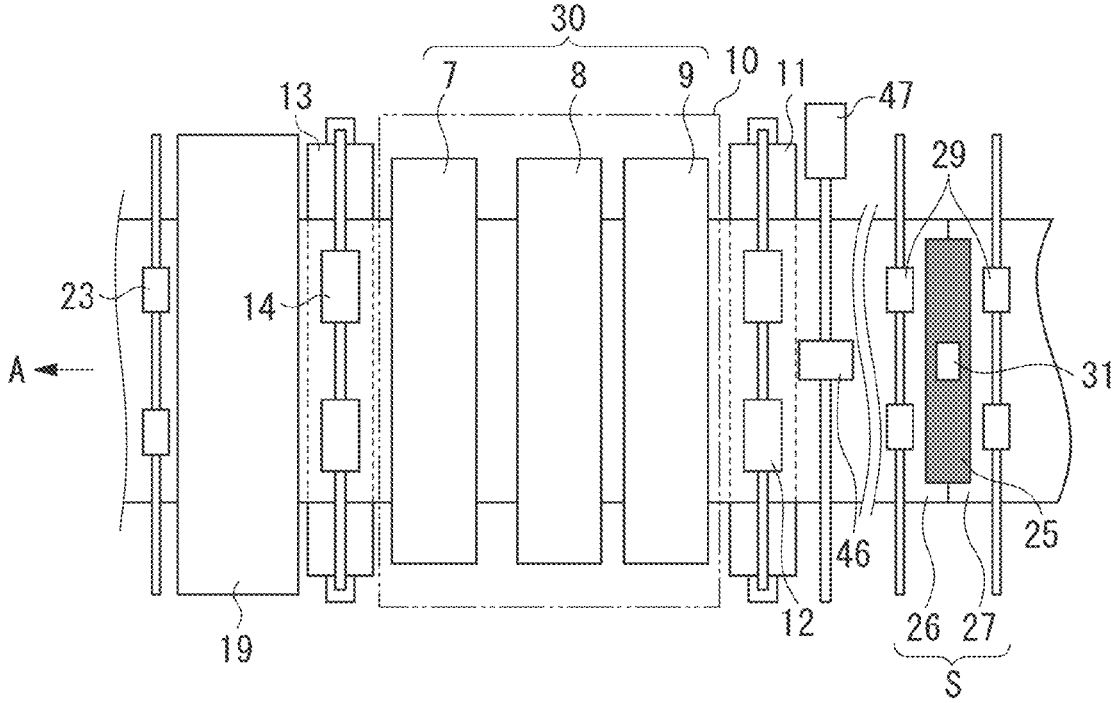
FIGS. 6A and 6B illustrate sheet conveyance adjustment according to a second exemplary embodiment.
Figure 6B:
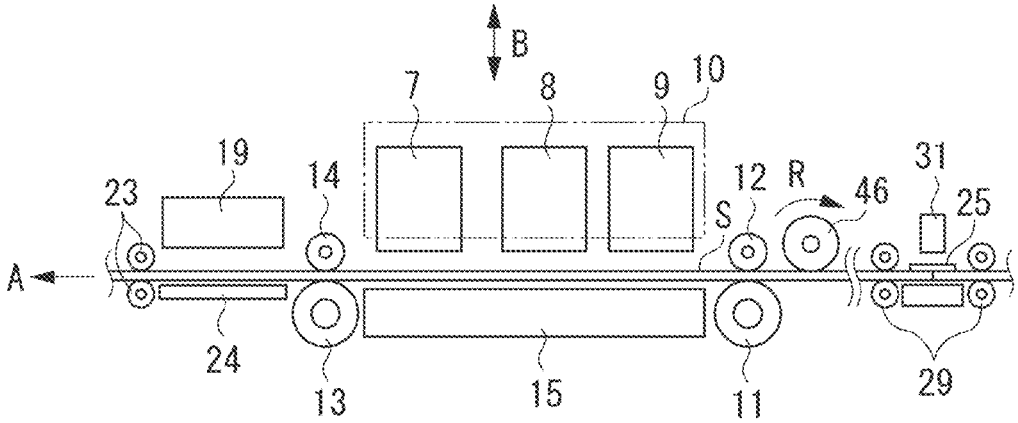

With reference to FIGS. 6A and 6B, conveyance adjustment according to a second exemplary embodiment is described. FIG. 6A is a top view, and FIG. 6B is a side view. In the exemplary embodiment, a detector (a direct sensor) that directly detects a conveyance state (a conveyance amount or a conveyance speed) of the sheet surface is used at a position upstream of the printing unit 30. The direct sensor is a contact direct sensor having a detection roller 46 and a rotary encoder 47. The detection roller 46 is disposed between the detection position of the detection unit 31 and the print position of the printing unit 30. The detection roller 46 is a driven roller that contacts the surface of the sheet, and is driven and rotated in conjunction with the movement of the sheet. To the rotary shaft of the detection roller 46, the rotary encoder 47 is connected. The rotary encoder 47 outputs a pulse signal in conjunction with the rotation of the detection roller 46. The pulse signal is counted to detect the sheet conveyance state, that is, a movement (a speed or an amount of movement) of the sheet surface. The rotary encoder 47 may be an optical rotary encoder, a magnetic rotary encoder, or a rotary encoder of any type.

In the conveyance adjustment in steps S100 and S105 in the flowchart in FIG. 4, in the conveyance adjustment in step S105, the above-mentioned contact-type direct sensor detects movement states of the preceding sheet area and the following sheet area being conveyed. In each of the preceding sheet area and the following sheet area, the control parameters relating to the sheet conveyance (the conveyance amount or the conveyance speed) are adjusted such that the sheet is appropriately conveyed. By the processing, even if the sheet conveyance characteristics differ in the preceding sheet area and the following sheet area, similar conveyance states can be achieved. As a result, the print quality of the series of the images sequentially printed on the continuous sheet can be similarly maintained.

According to the present exemplary embodiment, to detect the sheet conveyance states, it is not necessary to form an adjustment pattern on the sheet. Consequently, the consumption of the sheet and ink for purposes other than the original image printing can be reduced. In addition, the conveyance adjustment in steps S100 and S105 can be performed in a shorter time. As a result, the total print throughput can be increased.

Figure 7A:
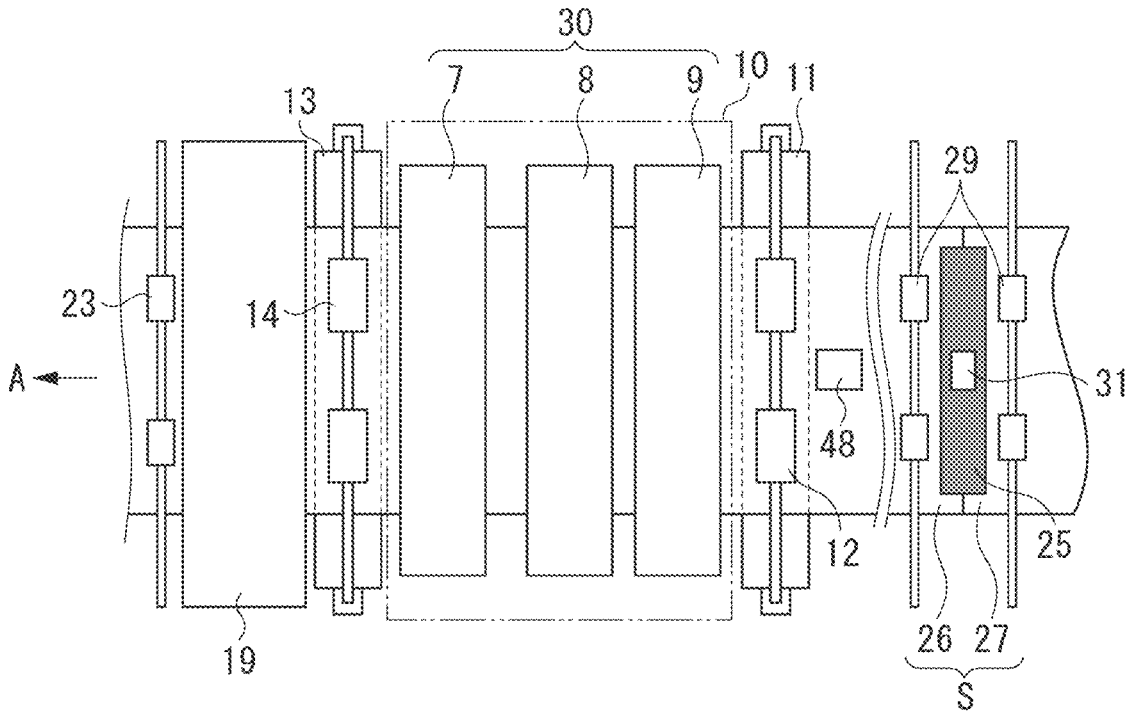
FIGS. 7A and 7B illustrate sheet conveyance adjustment according to a third exemplary embodiment.
Figure 7B:
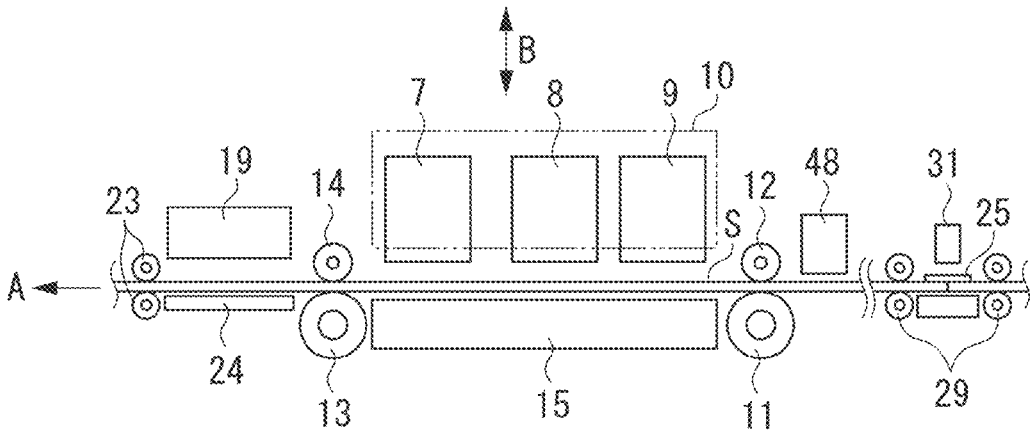

With reference to FIGS. 7A and 7B, a direct sensor according to a third exemplary embodiment is described. FIG. 7A is a top view, and FIG. 7B is a side view. The direct sensor is a non-contact direct sensor having an optical motion sensor 48. The motion sensor 48 can employ a Doppler velocimeter, an image sensor method, or the like. The Doppler velocimeter detects behavior of an interference pattern, which is generated by reflected light of coherent light such as laser emitted onto the sheet surface, and calculates and outputs the sheet conveyance state. In the image sensor method, a plurality of pieces of image data is acquired by capturing images of the surface of the moving sheet with a fixed image sensor a plurality of times. The acquired image data is compared using an image processing method such as a pattern matching, and thereby the sheet conveyance state is detected.

In the conveyance adjustment in steps S100 and S105 in the flowchart in FIG. 4, the above-mentioned non-contact type direct sensor detects the movement states of the preceding sheet area and the following sheet area being conveyed. In each of the preceding sheet area and the following sheet area, the control parameters relating to the sheet conveyance (the conveyance amount or the conveyance speed) are adjusted such that the sheet is appropriately conveyed. By the processing, even if the sheet conveyance characteristics differ in the preceding sheet area and the following sheet area, similar conveyance states can be achieved. As a result, the print quality of the series of the images sequentially printed on the continuous sheet can be similarly maintained.

According to the present exemplary embodiment, to detect the sheet conveyance states, it is not necessary to form an adjustment pattern on the sheet. Consequently, the consumption of the sheet and ink for purposes other than the original image printing can be reduced. In addition, the conveyance adjustment in steps S100 and S105 can be performed in a shorter time. As a result, the total print throughput can be increased. Further, since the sensor is the non-contact type direct sensor, physical damage to the sheet can be eliminated.

According to the above-described exemplary embodiments, the conveyance characteristics of the following sheet area 27 are acquired using the adjustment patterns or the direct sensor. The sheet information (the conveyance characteristics) can be acquired using a method other than the above-described methods. For example, on the sheet itself, the sheet information about the following sheet area 27 may be recorded or stored, and the sheet information may be read to perform conveyance adjustment.

FIG. 2A illustrates an example of a code pattern 28, which is recorded in advance in a part immediately after the tape 25 (in a top part of the following sheet area 27) of the splice on the sheet S. The code pattern is recorded on the sheet by the manufacturer in manufacturing the roll sheet. The detection unit 31 reads the code pattern 28 to acquire the sheet information about the following sheet area 27. The code pattern 28 records the information about the conveyance characteristics (for example, the type of sheet, the characteristics of sheet, and the thickness of sheet) of the following sheet area 27 in a form like a bar code. The position of the code pattern 28 is not limited to the following sheet area 27, but the code pattern 28 may be recorded on the tape 25 or in a rear end portion of the preceding sheet area 26. The code pattern 28 may be read not as an optical pattern, but as a magnetic pattern with a magnetic sensor. In the same area as the code pattern 28, an electronic mark such as an integrated circuit (IC) tag may be embedded in the sheet, and the sheet information may be electronically stored. The information may be read in a non-contact manner with an IC tag reader.

In any of the above-described exemplary embodiments, the conveyance adjustment corresponding to the conveyance characteristics of the following sheet area continuous from the splice of the continuous sheet is performed. Consequently, even if the sheet characteristics change before and after the splice, the printing can be continued while maintaining similar print image quality without giving a feeling of strangeness to the viewer.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium). An apparatus may be implemented within, include, or otherwise be connected to a central processing unit (CPU), where the CPU is connected to a memory and executes a variety of functions by executing a variety of application programs that are stored in the memory, such as a read only memory (ROM). The ROM may store such information as an operating system, various applications, a control program, and data. The operating system may be the software that controls the allocation and usage of hardware resources such as memory, central processing unit, disk space, and peripheral devices. A random access memory (RAM) may temporarily store the program or the data that is loaded from the ROM. The RAM also is used as a space wherein the CPU executes the variety of programs. In an example, a computer-readable storage medium may store a program that causes a printing apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-247810 filed Nov. 11, 2011, which is hereby incorporated by reference herein in its entirety.

What is claimed is:

1. A printing apparatus comprising:

a conveyance unit configured to convey a sheet that is a continuous sheet;

a printing unit configured to print an image onto the conveyed sheet;

a detection unit configured to detect a splice of the conveyed sheet, wherein a following sheet area follows and is continuous from the splice;

a direct sensor configured to detect moving speed or distance of the sheet; and a control unit configured to control, in response to the detection unit detecting the splice of the conveyed sheet, such that (i) the direct sensor detects the moving speed or distance of the sheet while the following sheet area is conveyed and (ii) the control unit adjusts a conveyance control parameter for the conveyance of the following sheet area depending on detected moving speed or distance before starting image printing on the following sheet area.

2. The printing apparatus according to claim 1, wherein a preceding sheet area precedes the splice, and wherein the control unit is configured to adjust conveyance of the preceding sheet area depending on conveyance characteristics of the preceding sheet area.

3. The printing apparatus according to claim 2, wherein information about the conveyance characteristics is acquired using the following sheet area.

4. The printing apparatus according to claim 3, further comprising a reading unit configured to read the image printed by the printing unit, wherein, based on a result of the reading unit reading the image printed on the following sheet area, the information about the conveyance characteristics is acquired.

5. The printing apparatus according to claim 1, wherein the direct sensor detects optically the moving speed or distance of a surface of the following sheet area that is conveyed by the conveyance unit.

6. The printing apparatus according to claim 5, wherein the direct sensor is configured to detect the surface of the following sheet area at a position upstream of a print position of the printing unit and downstream of a detection position of the detection unit.

7. A method for a printing apparatus, the method comprising:

conveying a sheet that is a continuous sheet;

printing an image onto the conveyed sheet;

detecting a splice of the conveyed sheet, wherein a following sheet area follows and is continuous from the splice;

detecting, using a direct sensor, moving speed or distance of the sheet; and controlling, in response to detecting the splice of the conveyed sheet, such that (i) the direct sensor detects the moving speed or distance of the sheet while the following sheet area is conveyed and (ii) controlling adjusts a conveyance control parameter for the conveyance of the following sheet area depending on the detected moving speed or distance before starting image printing on the following sheet area.

8. A non-transitory computer-readable storage medium storing a program that causes a printing apparatus to perform the method according to claim 7.

* * * * *